US005381928A

United States Patent [19]

Lee et al.

[11] Patent Number: 5,381,928

[45] Date of Patent: Jan. 17, 1995

[54] ACTION TOY WATER WEAPONS

[75] Inventors: James S. W. Lee, Long Island, N.Y.; Chiu K. Kwan, Kowloon, Hong Kong

[73] Assignee: C.J. Associates, Ltd., Hunghom, Hong Kong

[21] Appl. No.: 957,424

[22] Filed: Oct. 6, 1992

Related U.S. Application Data

[63] Continuation-in-part of Ser. No. 815,959, Jan. 2, 1992, Pat. No. 5,284,274.

[51] Int. Cl.[6] ..... A63H 3/18

[52] U.S. Cl. ..... 222/79; 124/65; 124/82; 222/209; 222/278; 222/327; 222/386

[58] Field of Search ..... 222/78, 79, 209, 262, 222/278, 325, 326, 327, 386; 446/405, 473; 124/65, 66, 67, 82

[56] References Cited

U.S. PATENT DOCUMENTS

| | | | |
|---|---|---|---|
| 967,140 | 8/1910 | Mamaux | 222/79 |
| 1,782,479 | 11/1930 | Sadtler | 222/79 |
| 3,022,779 | 2/1962 | Benkoe | 222/79 X |
| 3,575,318 | 4/1971 | Kunz | 222/79 |
| 3,877,611 | 4/1975 | Morrison et al. | 222/78 |
| 4,911,364 | 3/1990 | Irie | 222/79 X |
| 5,224,464 | 7/1993 | Burnham et al. | 124/67 |
| 5,241,944 | 9/1993 | Rappaport | 124/67 |

FOREIGN PATENT DOCUMENTS

| | | | |
|---|---|---|---|
| 0027571 | 9/1980 | European Pat. Off. . | |
| 63-23594 | 2/1988 | Japan . | |
| 2098078 | of 0000 | United Kingdom | 222/79 |
| 2132494 | 11/1983 | United Kingdom . | |
| 2209004 | 4/1989 | United Kingdom . | |

OTHER PUBLICATIONS

English translation to 63-23594.

*Primary Examiner*—Andres Kashnikow
*Assistant Examiner*—Joseph A. Kaufman
*Attorney, Agent, or Firm*—Laff, Whitesel, Conte & Saret, Ltd.

[57] ABSTRACT

An action toy system including a capsule for containing water having an orifice and a plunger and a spring loaded mechanism for driving the water from the orifice. The action toy may be configured as a shotgun accepting a plurality of prefilled shell capsules into its breechblock for firing through its barrel. It may also be configured as a missile launcher in which the capsules are mounted to the front of the launcher and the water is ejected directly from the capsule against the target. In yet another embodiment, the invention is configured as a crossbow with the bow loading the spring-loaded mechanism and a water stream obtained on release of the bow. In a still further embodiment, the action toy is fitted with a double feature nozzle for either producing a stream of water or propelling an object.

27 Claims, 18 Drawing Sheets

ACTION TOY WATER WEAPONS

This application is a continuation-in-part of U.S. patent application Ser. No. 07/815,959, filed Jan. 2, 1992, now matured into U.S. Pat. No. 5,284,274.

FIELD OF THE INVENTION

This invention relates to toys designed to be carried and used by children engaged in action play. More particularly, this invention relates to new action toy weapons which enable a child to produce and direct a liquid stream from a toy in ways which uniquely resemble the operation of real weaponry.

BACKGROUND OF THE INVENTION

Squirt guns and other toys for producing water streams have been available in the marketplace for many years. These toys typically include an internal refillable reservoir for holding a small quantity of water. The reservoir is drawn upon, as needed, to eject or "squirt" the water from the toy until the reservoir is exhausted.

Such prior art toys do not resemble real weapons in their operation which detracts from the realism and play value of the toys. Also, repeatedly refilling the small water reservoirs in such toys is cumbersome and detracts from the fun of using the toys.

SUMMARY OF THE INVENTION

Accordingly, it is an object of this invention to provide an action toy system which operates in a fashion uniquely resembling real weapons.

It is a further object of the invention to provide an action toy system including prefilled shell-like capsules which may be loaded into and ejected from a toy weapon or other play device.

It is another object of the present invention to provide a toy weapon or other play device which will accept a multiplicity of capsules prefilled with water for ejection of the water from successive capsules either directly from the capsules or indirectly through the toy weapon or other play device.

It is yet another object of the present invention to provide readily filled and readily replaceable capsules which can be used in lieu of the internal water reservoir of conventional squirt gum.

A still further object of the present invention is to provide a toy weapon or other play device having a spring-loaded mechanism for emptying a water reservoir.

Another object of the present invention is to provide a toy weapon or other play device having a mechanism for emptying a water reservoir in a single operation.

It is a further object of the present invention to provide convenient and practical methods for filling capsules to be used in squirt guns and other play devices designed to produce water streams.

A yet further object of the present invention is to provide action toys which eject water and incorporate more than one type of weapon play.

It is a further object of the present invention to provide a single toy weapon or other play device which may be used to alternatively produce a water stream or to propel an object.

Still a further object of the present invention is to provide action toys in the form of shotguns, rifles, missile launchers, and bow and arrows.

These and other objects of the present invention will become apparent to those skilled in the art upon consideration of the accompanying specification, claims and drawings.

In one important embodiment, the present invention entails an action toy system employing a removable capsule for containing a liquid, such as water, which is ejected through a toy gun, missile launcher or other toy such as a tank, a cannon or a jet fighter when the capsule is mounted in the toy and the toy is triggered. Although the capsule, as described below, is designed for repeated refilling, it is contemplated that single use, prefilled capsules could be used in the practice of the present invention. Thus, when the child decides to use the toy weapon, he pulls a trigger mechanism to drive the water either directly from the capsule or into the appropriate passages of the "weapon" from which it is either directly or indirectly ejected.

In another important embodiment, the present invention comprises a toy weapon, illustrated below in the form of missile launcher, wherein a water-filled capsule is mounted to the front of the unit and the water is driven directly from the orifice of the capsule to the target upon release of a cocked spring within the unit. In yet another embodiment of the invention, a combination toy "weapon" is provided comprising, for example, a toy shot gun which accepts a plurality of prefilled capsules in combination with an automatic rifle having its own water reservoir, from which water is "shot" upon activation of the rifle trigger, or from which water may be continuously squirted from the shotgun in a pump-action fashion.

Another significant embodiment of the invention comprises a crossbow system which operates somewhat like a conventional crossbow, storing energy in a spring which is cocked by pulling back on the bow. In this system, however, when the bow is released, a stream of water rather than an arrow shoots from the weapon.

In a further embodiment of the invention, a toy weapon, illustrated below in the form of a crossbow, is provided with a double feature nozzle which can alternatively produce a water stream or propel an object. The object may be made of a light, resilient material like foamed polyethylene and formed into the shape, e.g., of an arrow or a missile.

BRIEF DESCRIPTION OF THE DRAWINGS

The features of this invention which are believed to be novel are set forth with particularity in the appended claims. The invention, together with its objects and advantages, may be best understood by reference to the following description taken in conjunction with the accompanying drawings, in which like reference numerals identify like elements in the several figures, and in which:

DESCRIPTION OF THE PREFERRED EMBODIMENTS

Figure 1:
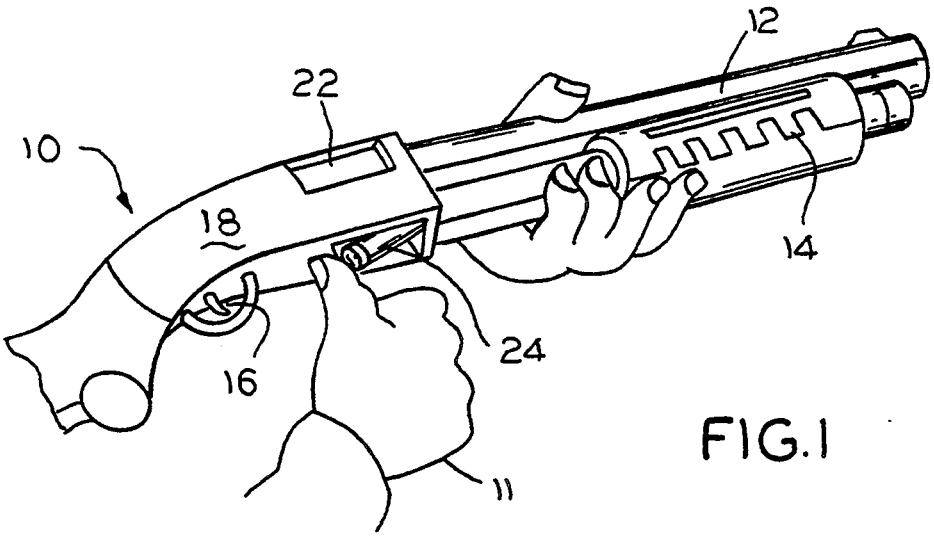
FIGS. 1, 2 and 3 are perspective views of a toy shotgun constructed in accordance with the present invention, in the hands of a child first loading a shell-like water-filled capsule into the gun and then operating the gun.
Figure 2:
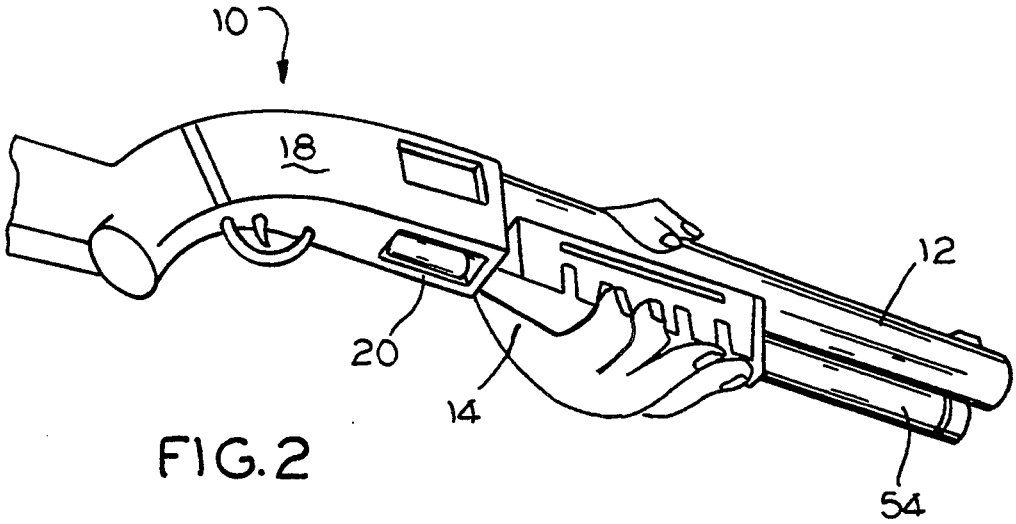
Figure 3:
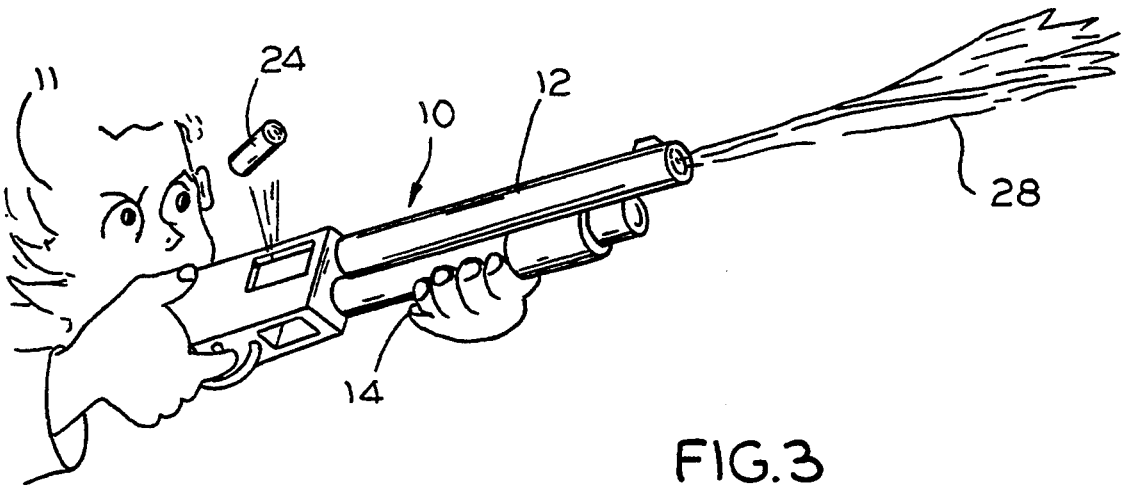

Turning first to FIGS. 1–3, there is illustrated, in the hands 11 of a child, a toy pump-action shotgun 10 having a barrel 12, a slide handle 14 and a trigger 16. The shotgun includes a receiver 18 having a loading gate 20 and a breechblock 22. In FIG. 1, a prefilled capsule of water in the shape of shotgun shell 24 is shown being inserted into the loading gate of the toy shotgun.

Once the appropriate number of shell capsules have been loaded into the shotgun, slide handle 14 is drawn back, as shown in FIG. 2, cocking the shotgun for action in the manner described below. When the child wishes to fire the weapon by ejecting the water from a capsule, he merely pulls back on trigger 16 which produces water stream 28, as depicted in FIG. 3. The first capsule is then automatically ejected from the breechblock as slide handle 14 is drawn back for the next shot, and the second capsule moves into place, ready for firing.

Figure 4A:
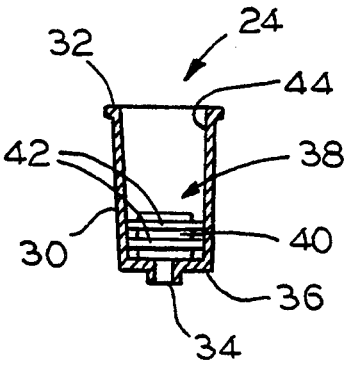
FIGS. 4A and 4D respectively illustrate, in elevation, capsules used in the toy shotgun of FIGS. 1-3, before filling and after filling, and FIGS. 4B and 4C respectively illustrate, in plan view, an apparatus used in filling the capsules.

Shell capsule 24 is illustrated in FIG. 4A. Capsule 24 comprises a barrel portion 30 open at its top end 32 and having a central orifice 34 at its bottom end 36. A plunger 38 is freely longitudinally moveable in the barrel portion of the capsule. The plunger comprises a stopper 40 with rubber "O" rings 42 which sealingly engage the inner wall 44 of the barrel portion. In FIG. 4A, the capsule is shown in its empty condition; in FIG. 4D it is shown in its loaded condition, after filling with water 46, as explained below.

Figure 4B:
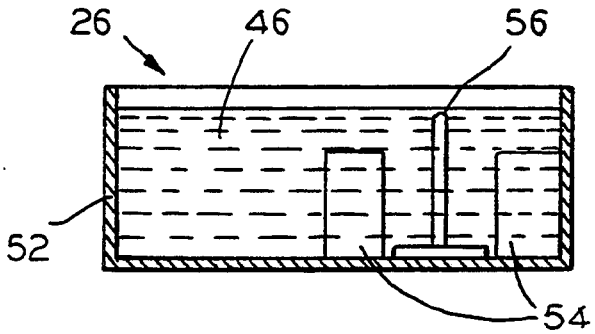
Figure 4C:
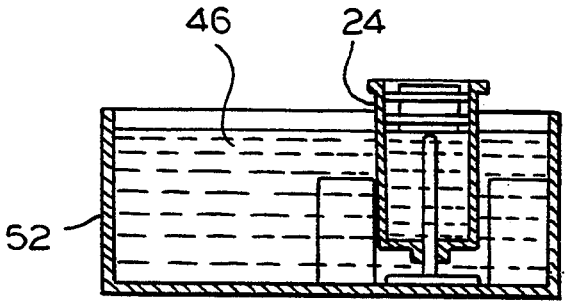
Figure 4D:
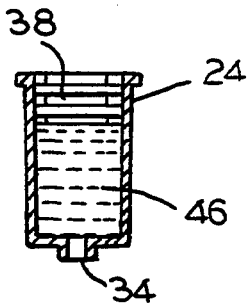
Figure 5A:
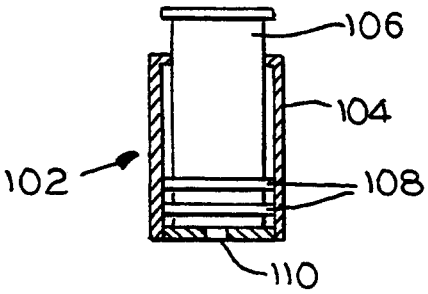
FIG. 5A is a elevation view of an alternate embodiment of the capsule of FIG. 4A
Figure 5B:
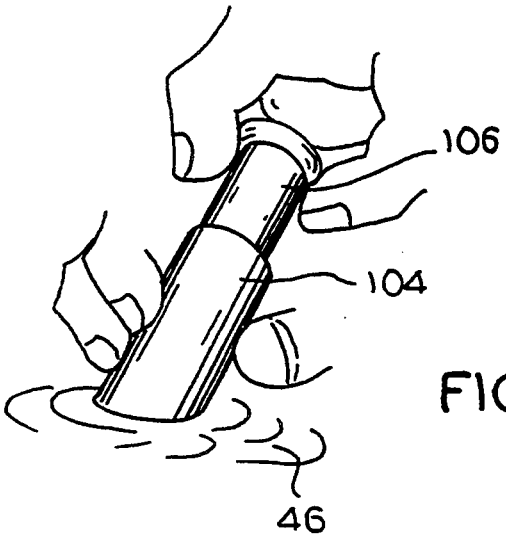
FIG. 5B is a perspective view illustrating a procedure for filling the capsule of FIG. 5A.

FIGS. 4B and 4C illustrate an apparatus 26 for filling capsule 24. The apparatus includes a water container 52 having a circular collar 54, shown in cross-section, for receiving the capsule, and a pin 56 located on the central axis of the collar in line with orifice 34 of the capsule. Thus, an empty capsule may be filled by placing it upon the pin, with the pin engaged in the orifice, and pushing down, causing plunger 38 to move from bottom 36 to top 32 of the capsule, while drawing water 46 from container 52 into the capsule body. The capsule is then removed from the collar, ready for loading into the toy shotgun. In a preferred embodiment, to prevent leakage from the filled capsule, the clearance between orifice 34 and pin 56 will be about 0.5 mm to 1.0 mm, and the diameter of the orifice will be less than about 2.5 min.

In FIGS. 5A–5B and 6A–6C, alternative designs of a refillable capsule are illustrated. Thus, in FIG. 5A a two-part syringe-type capsule 102 is illustrated which includes a shell 104, shown in cross-section, and a solid plunger portion 106 having rubber "O" rings 108 to seal against the inner surface of the shell. The shell includes an orifice 110. This shell is filled by simply submerging orifice 110 in water (FIG. 5B) and pulling back upon the plunger to draw the water into the shell. Orifice 110 must be kept small enough to prevent air from entering the capsule to displace the water and cause leakage.

Figure 6B:
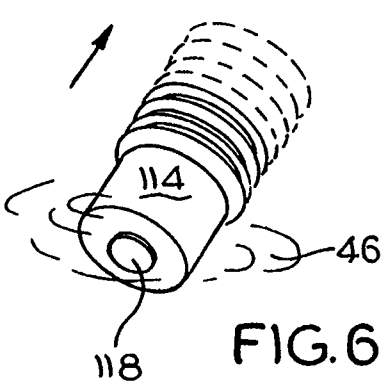
FIG. 6B is a perspective view illustrating a procedure for filling the capsule.
Figure 6C:
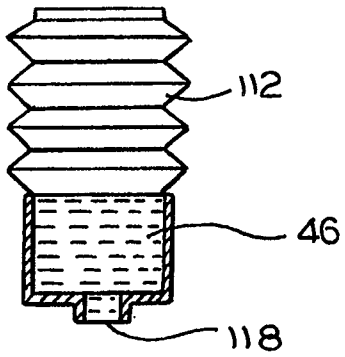
FIGS. 6A and 6C are, respectively, elevation views of yet another alterative embodiment of the capsule of the invention in empty and filled states
Figure 6A:
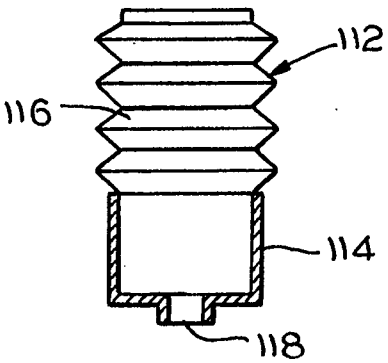

In FIGS. 6A–6C, a bellows-type capsule 112 is illustrated, including a rigid portion 114, a bellows portion 116 and an orifice 118. In order to fill this shell, the bellows are compressed and, as shown in FIG. 6B, the orifice is submerged in water, and the bellows are permitted to expand to draw the water 46 into the capsule, as depicted in FIG. 6C. The sizes and shapes of the capsules of FIGS. 4, 5 and 6 and the corresponding sizes and shapes of the various components of the shotgun which receive and manipulate the capsules will be readily chosen by those skilled in the art.

The internal operating mechanism of shotgun 10 is illustrated in FIGS. 7–11. Thus, in FIG. 7, a series of four water-filled shell capsules 24A–24D are shown resting in magazine tube 58. The capsules are held snugly in place between a compressed spring 60 and a backstop 62, shown in enlarged form in FIG. 7A.

Figure 9:
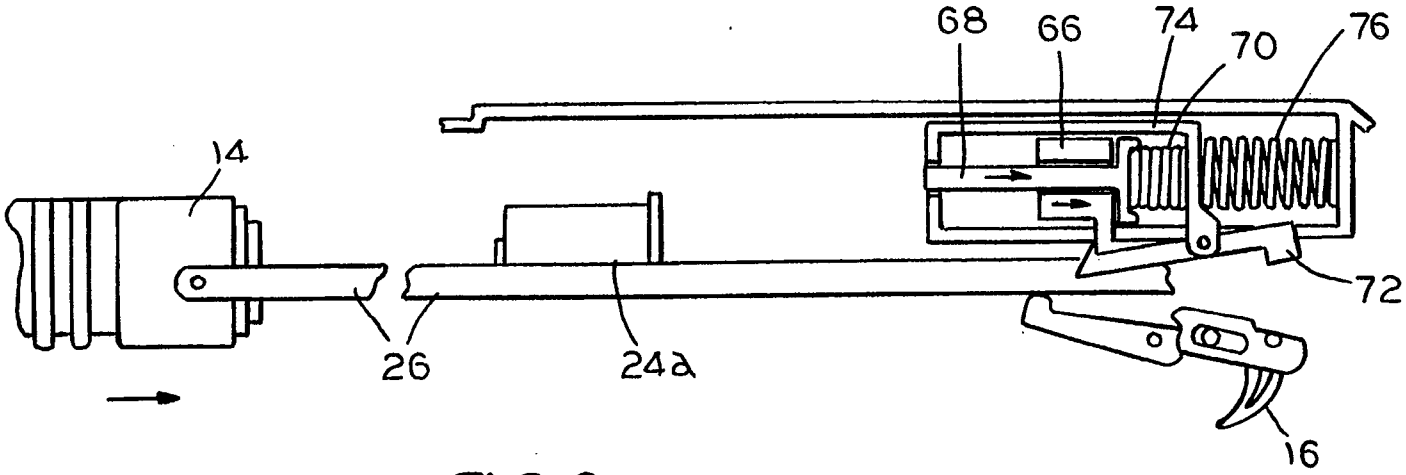

When slide handle 14 is drawn back, the upwardly projecting proximal nub 50 on link arm 26 (FIG. 8) which is attached to the slide handle and rests against catch 64 of plunger control 66, draws plunger 68 against proximal spring 70, to compress the spring. Spring 70 is locked in its compressed state by catch 72 which ramps over the catch 64 and snaps into place as illustrated in FIG. 9, while the continuing movement of the plunger carries latch housing 74 rearwardly to compress distal spring 76 as well. The slide handle is then moved forward to its "ready" position, permitting latch housing 74 to move forward under the force of the expanding distal spring 76 to engage the first capsule 24*a* which has been moved into position during the operation of the slide handle, as described below in connection with FIG. 10.

Figure 10:
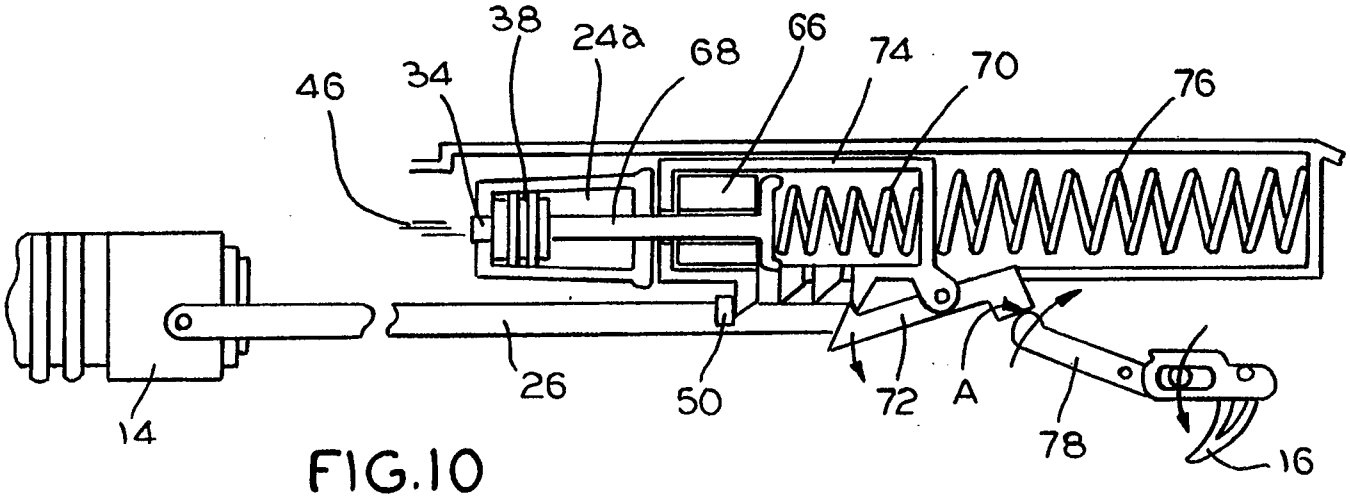

In FIG. 10, latch housing 74 is shown engaged with capsule 24A under the pressure produced by distal spring 76. As trigger 16 is squeezed, it pivots release lever 78 upwardly to engage catch 72 at A, releasing plunger control 66 and driving plunger 68 against capsule plunger 38 under the force stored in proximal spring 70, thereby forcing water 46 from the capsule through orifice 34, and past chamber orifice 79 into an intermediate chamber 80 (FIG. 11) in communication with the bore 82 in shotgun barrel 12 through which the water is directed to produce a forceful and sustained stream of water 28 (FIG. 3). Chamber 80 holds the first shot of water to insure that a stream of water will emerge from the shotgun with the engagement of every capsule except the first. Intermediate wall 83, spring 84 and pin 86 together act as a one-way valve so that water can enter chamber 80 by force from the capsule but will not escape.

Figure 7:
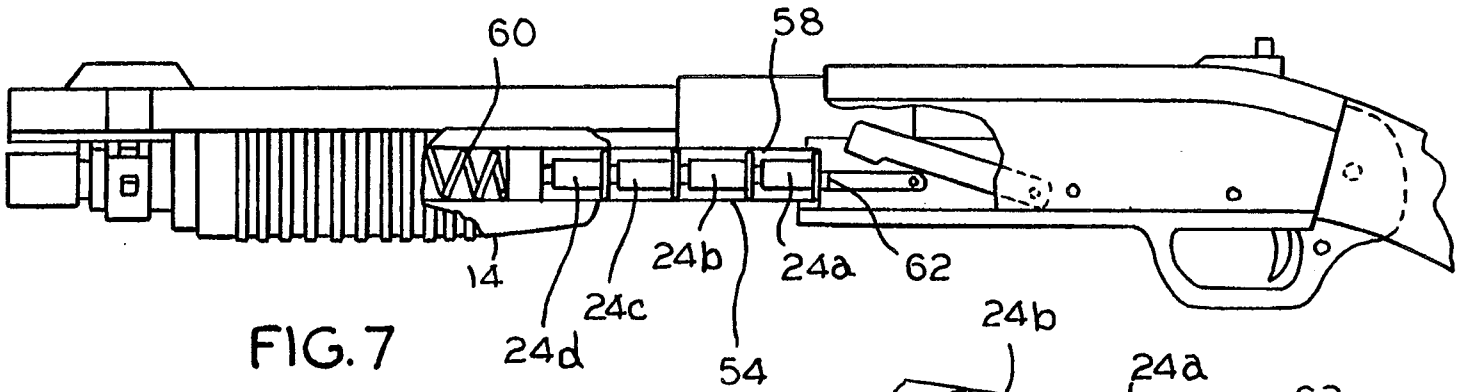
FIG. 7 is a partial elevation view of the toy shotgun of FIG. 1, which has been cut away to show certain internal features of the toy
Figure 7A:
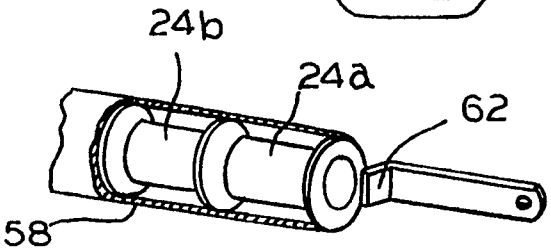
FIG. 7A is an enlarged fragmentary view of one of those details.
Figure 8:
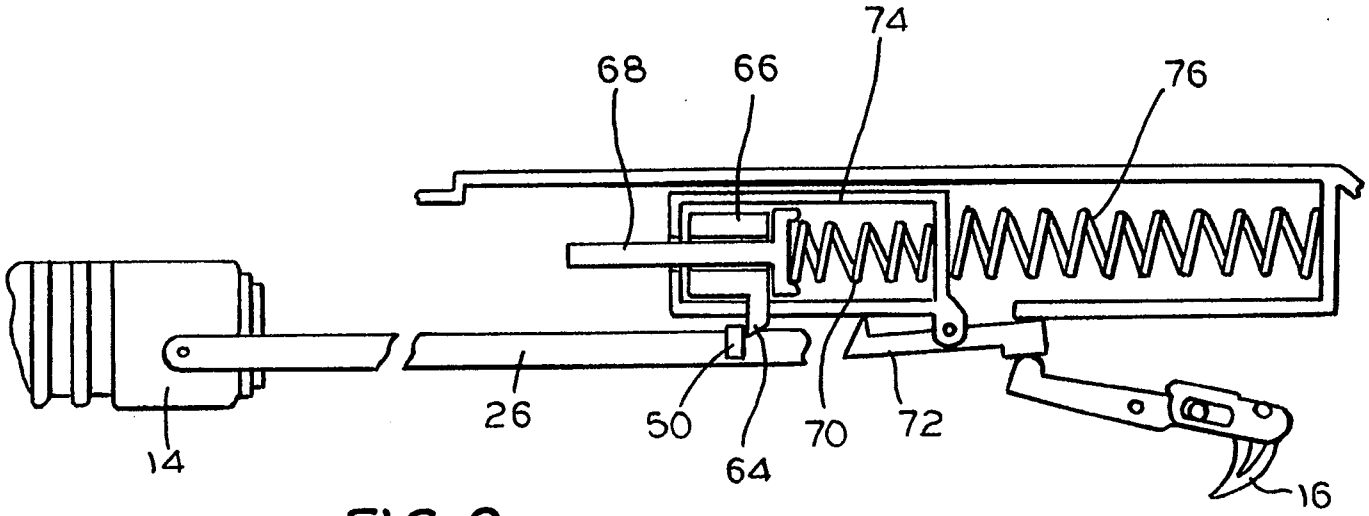
FIGS. 8, 9, 10, and 11 are further partial elevation views of the toy shotgun of FIG. 1, cut away to reveal selected internal features.
Figure 11:
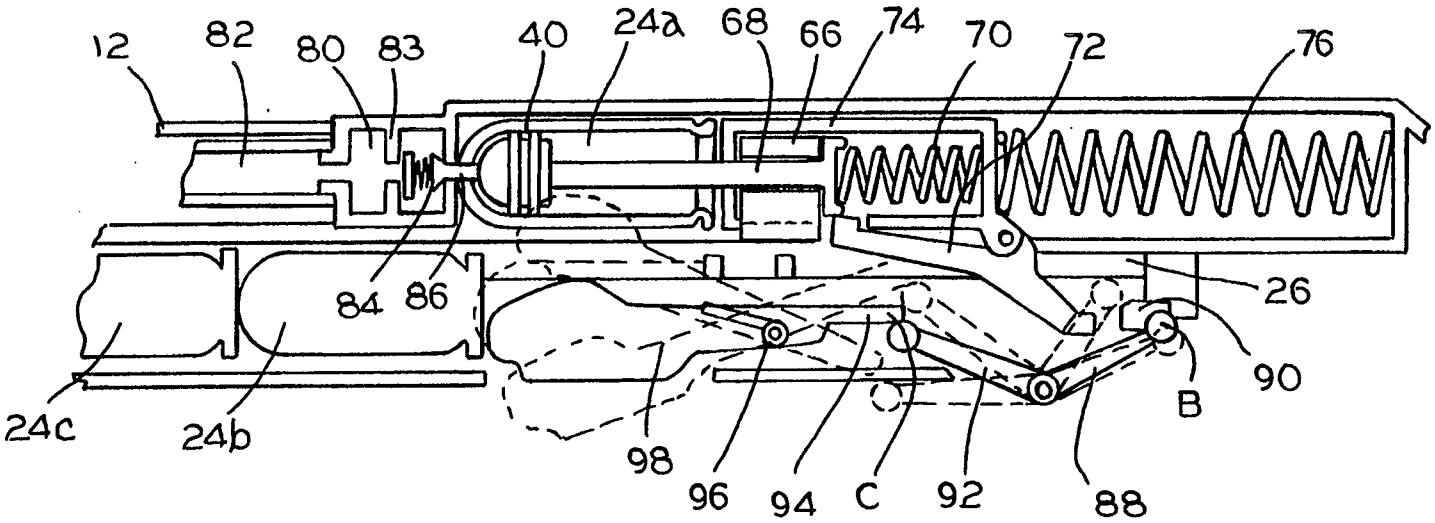

The movement of fresh capsules into the breechblock is illustrated in FIG. 11. As shown there, the rearward movement of link arm 26 compresses springs 70 and 76 releasing the pressure of latch housing 74 against the capsule thereby permitting the spent capsule to be pushed from the chamber under the force of the next entering capsule. As the backward motion of the link arm continues, lever 88 of load arm 87 is rocked downwardly at B under the force of distal nub 90 of link arm 26. This pivots the proximal arm 92 of the lever upwardly to engage the load arm lever at C and to pivot it about axis 96, moving the load arm carriage 98 downwardly to receive the next capsule which is moved into place under the action of spring 60 (FIG. 7). As link arm 26 is then returned to its forward position, spring 100 causes the load arm lever carriage to pivot back to its resting position with the capsule in breechblock 22 engaged by latch housing 74, and ready for firing.

Figure 12:
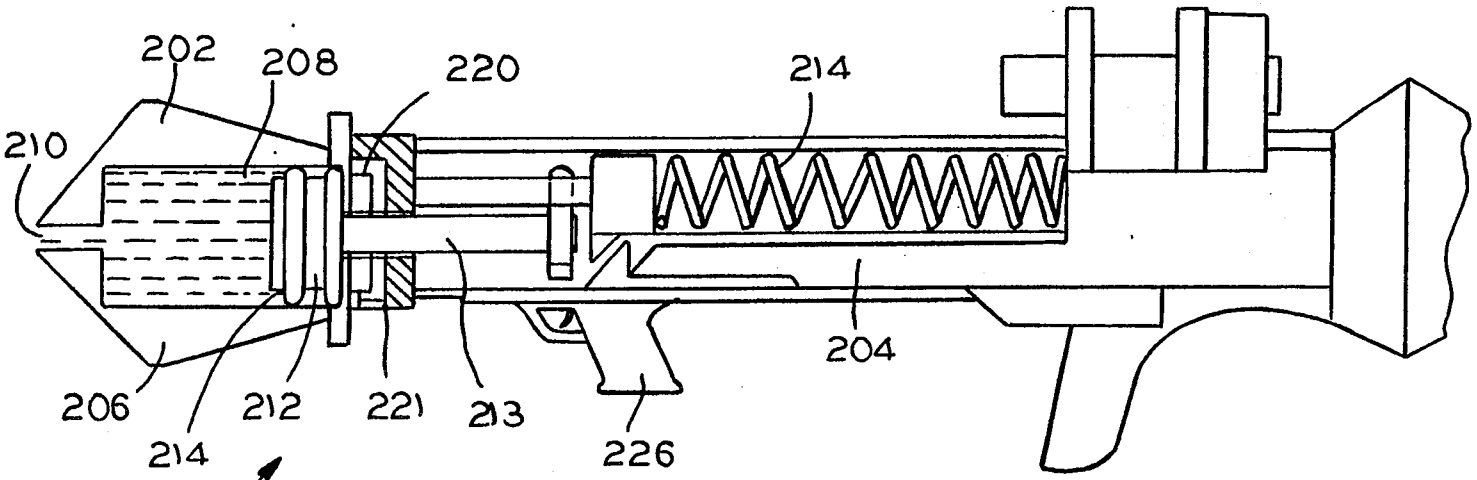
FIG. 12 is a partially cut-away elevation view of a toy missile launcher comprising an alternate design of the present invention.

Another embodiment of the invention is illustrated in FIGS. 12–17. In this embodiment, the toy weapon is a missile launcher. Thus, missile launcher 200, as illustrated in FIG. 12, includes a water-filled missile capsule 202 and a launcher unit 204 with sight 205. The water-filled missile capsule includes a housing 206 having a water reservoir 208 and an orifice 210. A plunger 212 is provided in the missile capsule, including a pair of resilient tings 214 for sealingly engaging the inner cylindrical surface of the water reservoir.

Figure 13:
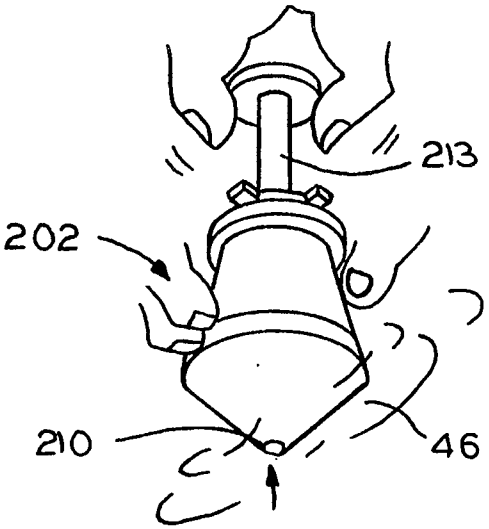
FIG. 13 is a perspective view illustrating a missile capsule, intended for use with the missile launcher of FIG. 12, being filled with water.

The features and operation of this embodiment of the invention may be best understood by examining the loading, cocking, and firing of the toy missile launcher which proceeds as follows:

A. In FIG. 13, missile capsule 202 is shown being loaded by submerging orifice 210 in water 46 and pulling up upon the control arm 213 of plunger 212, to draw the water into reservoir 208. (See FIG. 12.)

Figures 14, 14A, 14B:
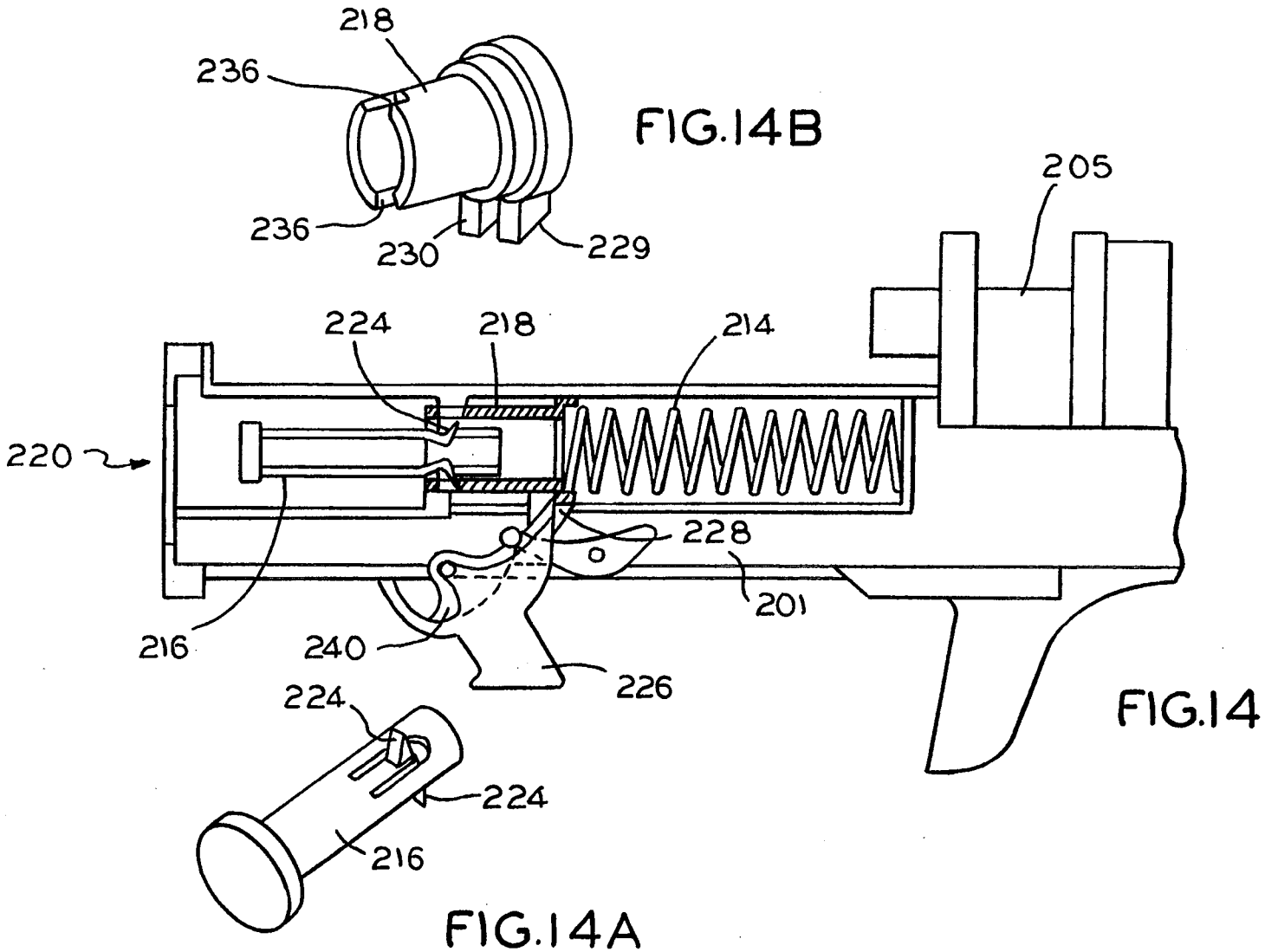
FIG. 14 is a partially cut-away elevation view of the launcher unit of the embodiment of FIG. 12 highlighting the cocking mechanism of the device and FIGS. 14A and 14B are enlarged perspective views of two key components of that cocking mechanism.

B. Turning now to launcher unit 204, spring 214 is shown in FIG. 14 in its relaxed position, with interlocking plungers 216 and 218 ready to receive a water-filled missile capsule. Thus, as capsule 202 is inserted into the barrel 220 of the weapon, control arm 213 of plunger 212 pushes front plunger 216 to the rear through plunger 218 until the radially protruding lip 224 of the front plunger engages the rear plunger and presses it up against spring 214, whereupon the missile is rotated by the child into a locked position in a conventional bayonet mount 221.

Figure 15:
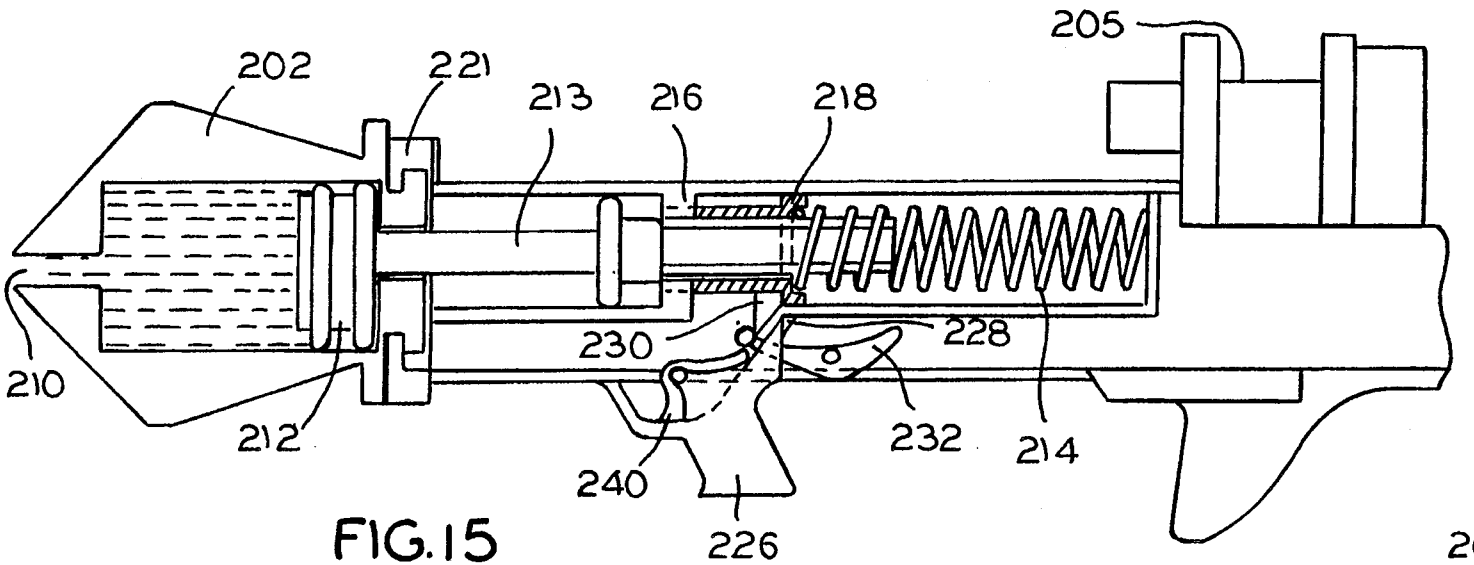
FIGS. 15–17 are partially cut-away elevation views of the missile launcher illustrated in FIGS. 12–14, showing the operation of the toy weapon.
Figure 16:
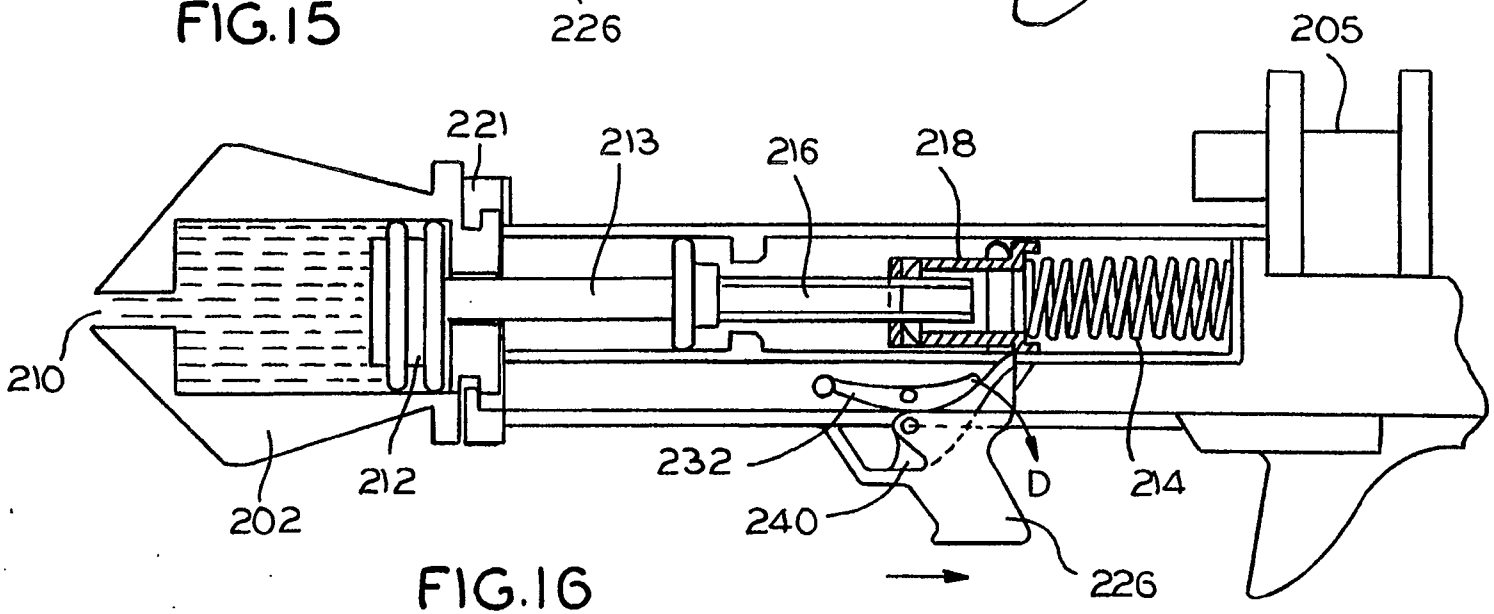

C. Handle 226 is then pulled back, as shown in FIGS. 15 and 16, engaging the rear pawl 228 of rear plunger 218 to compress or load spring 214. This rearward movement of the handle brings front pawl 230 of the rear plunger into engagement with the rear arm of trigger lever 232 which, as it snaps into place as shown in FIG. 16, indicates that spring 214 is fully loaded. At the same time, lips 224 of spring arms 225 of the front plunger 216 (FIG. 14A) engage slots 236 of the rear plunger (FIG. 14B) to lock the front plunger firmly in place. Handle 226 is then returned to its forward position leaving spring 214 fully cocked with trigger 240 engaging the front arm of trigger lever 232.

Figure 17:
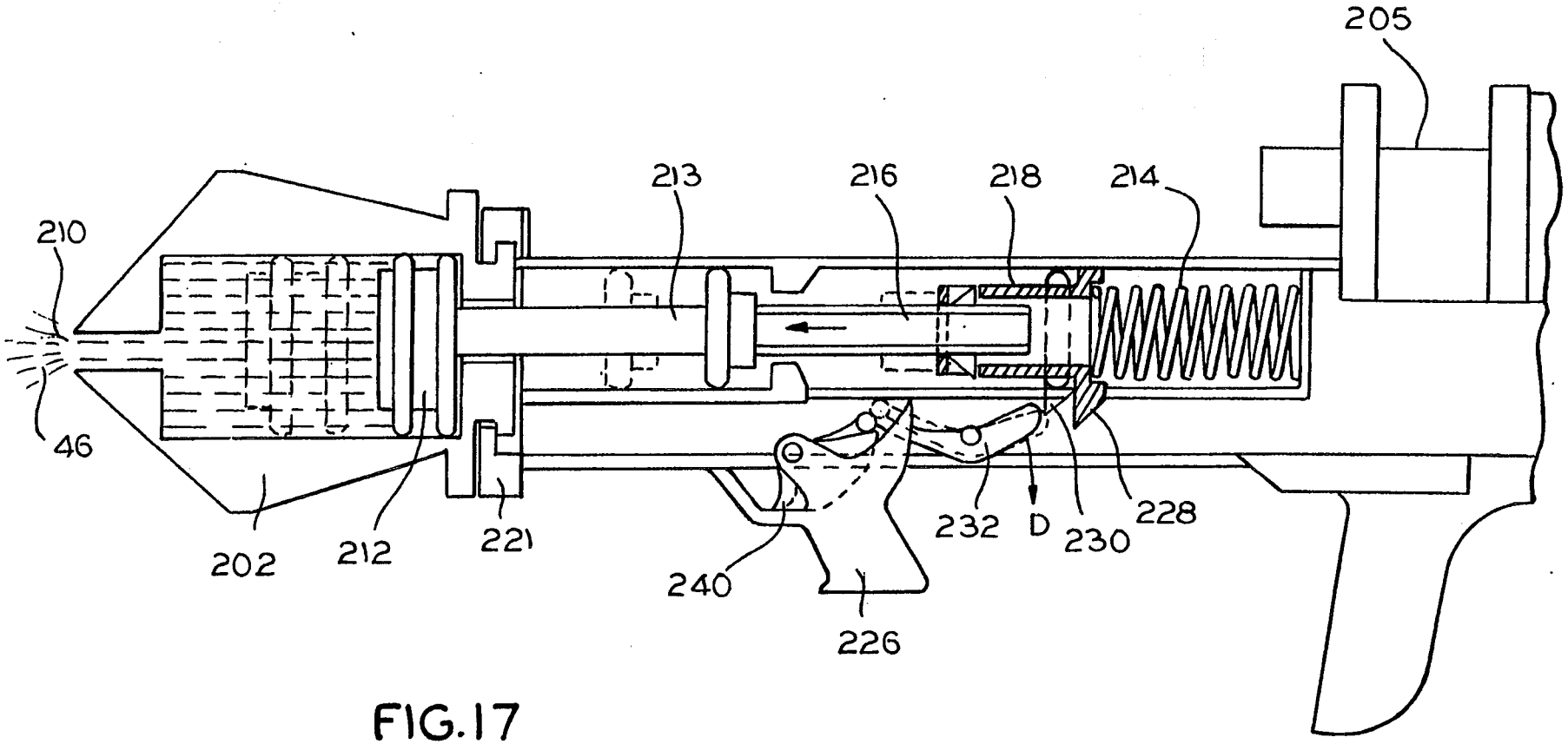

D. When trigger 240 is pulled, trigger lever 232 is pivoted downwardly at D, as illustrated in FIG. 17, thereby releasing rear plunger 218. Spring 214 then drives plungers 216 and 218 and control arm 213 of the missile plunger forward to force water 208 through nozzle 210 of the missile capsule.

E. When the missile capsule is empty, the child rotates it to unlock the bayonet mount and he or she replaces it with another prefilled missile.

Figure 18:
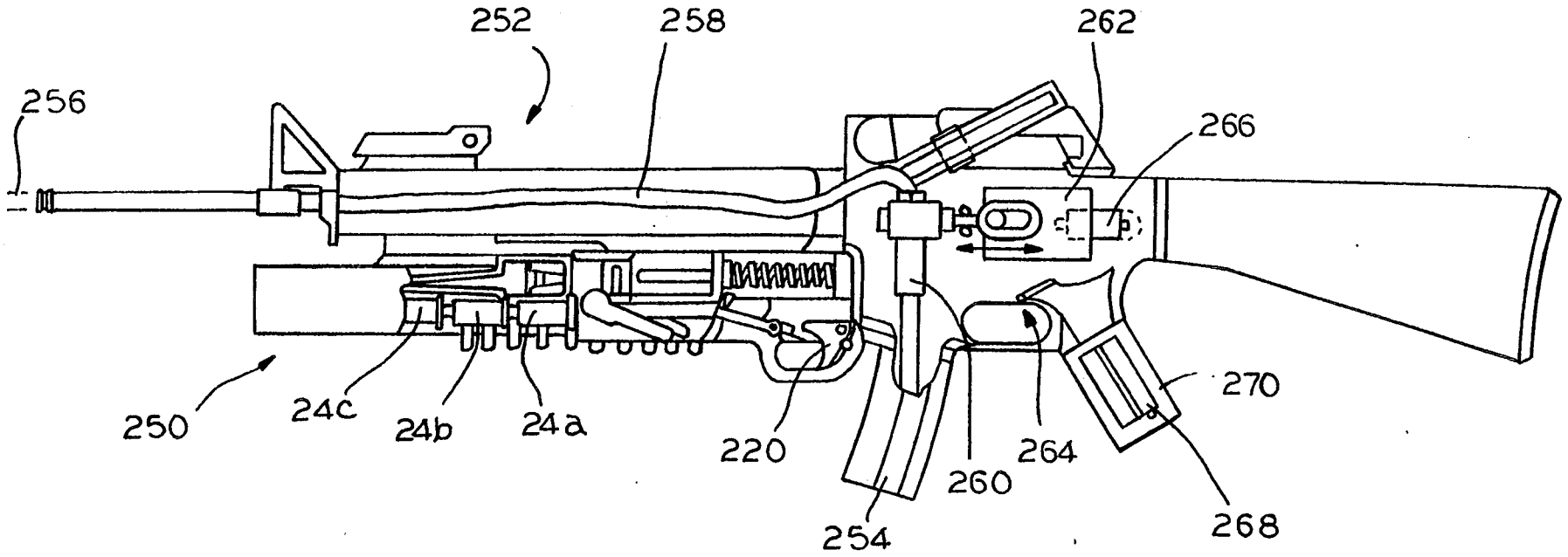
FIG. 18 is a partially cut-away elevation view of a combination shotgun/rifle toy in accordance with the invention.
Figure 19:
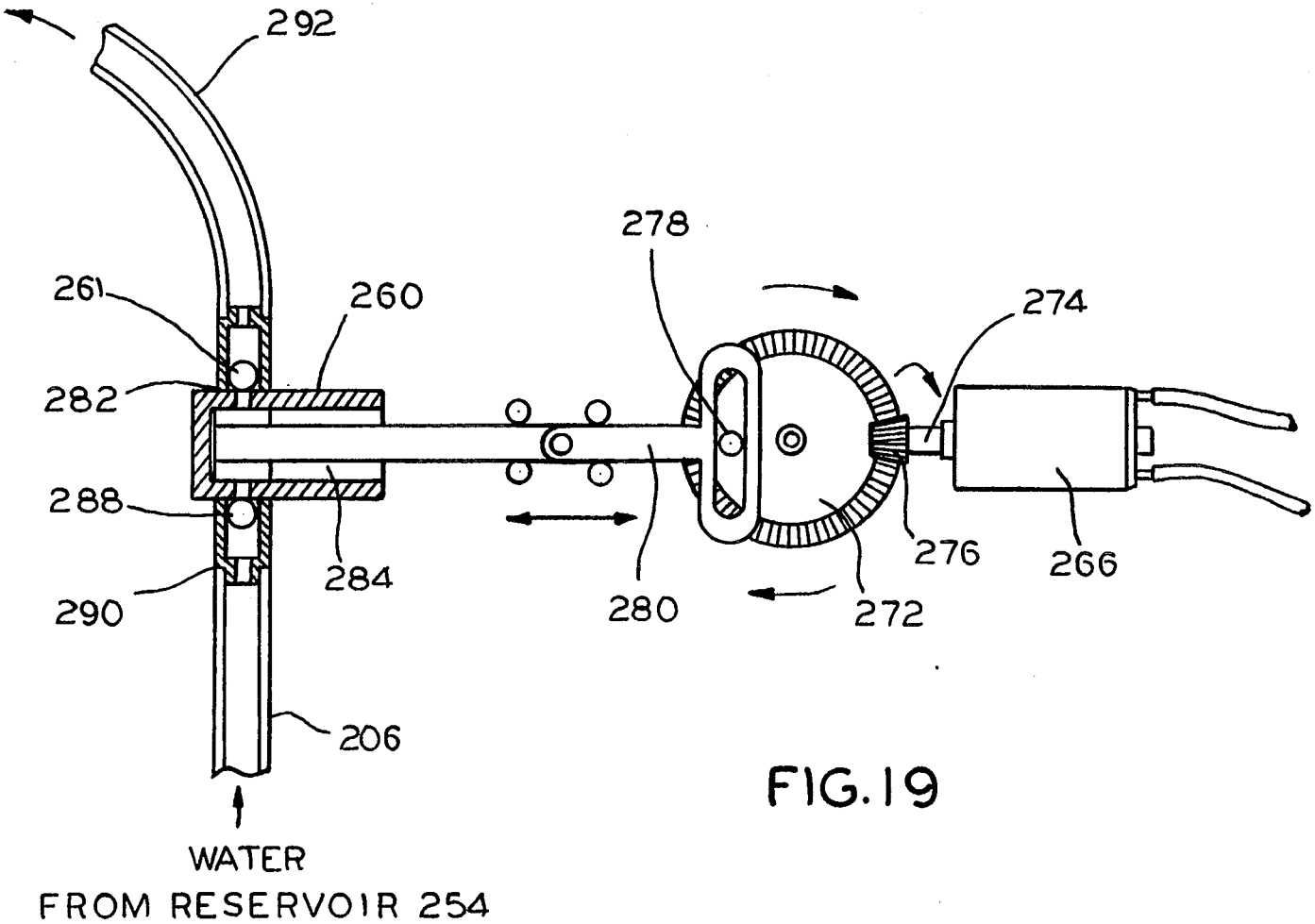
FIG. 19 is an enlarged view of the pump mechanism of the rifle of the combination toy weapon of FIG. 18.

Turning now to FIGS. 18 and 19, there is illustrated a combination toy comprising toy shotgun 250 using prefilled capsules 24*a*, 24*b* and 24*c*, as described above, and an automatic rifle 252 with a water reservoir 254 which can be filled by conventional means and clipped into place as shown.

Automatic rifle 252 includes a nozzle 256, a tube 258, a pump unit 260, a gear box 262, and a motor 266. Batteries 268 for running the motor are held in a pistol grip 270. Thus, as seen in FIG. 19, automatic rifle 252 is operated by pressing trigger 264 to activate motor 266 driving tapered pinion 276 on the shaft 274 of the motor which rotates in a counterclockwise direction causing gear 272 to rotate in a clockwise direction. Shaft 278, which is connected to piston shaft 280, converts this rotating action into linear movement. Thus, when piston shaft 280 is pulled to the right of pump unit 260, and steel ball 281 caps opening 282, a vacuum is created in the chamber 284 of the pump. Accordingly, the water inside reservoir 254 will be drawn into the pump chamber through hose 286, opening the input valve (steel ball 288). When piston shaft 280 is pushed forward, steel ball 288 closes off opening 210 to prevent water from returning to the reservoir while pushing the other ball 281 up to opening 282 to permit the water to be driven through hose 292 and out of nozzle 256.

Alternatively, the child may operate the toy in the shotgun or "capsule" mode, by loading water filled capsules into the shotgun portion 250 of the weapon, as described above in connection with FIGS. 1–11, and then pressing trigger 220 to drive the water from successive capsules, which are ejected from the toy when spent.

Figure 20:
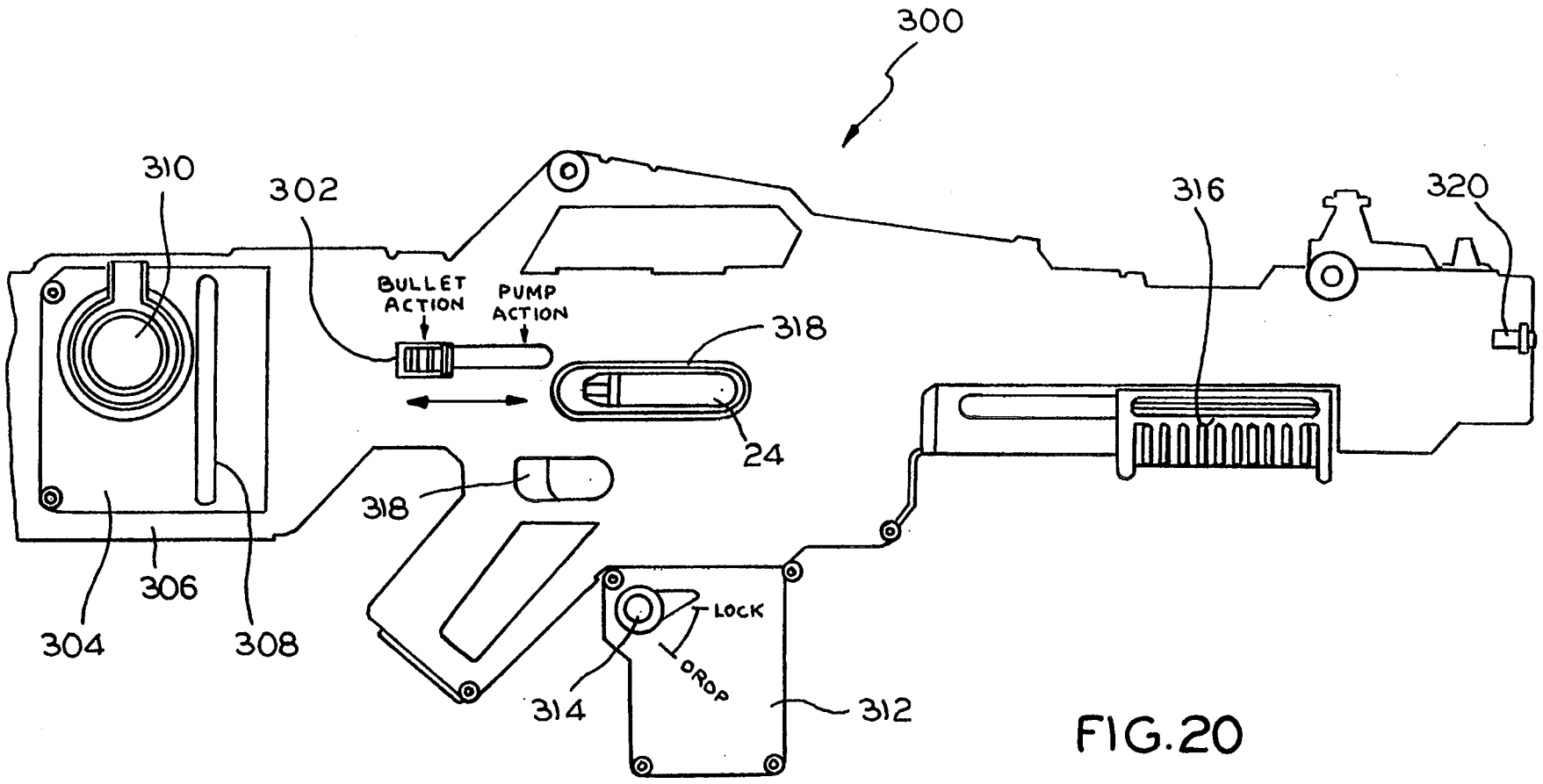
FIG. 20 is a side elevation view of a combination bullet action/pump action toy weapon in accordance with the invention.
Figure 21:
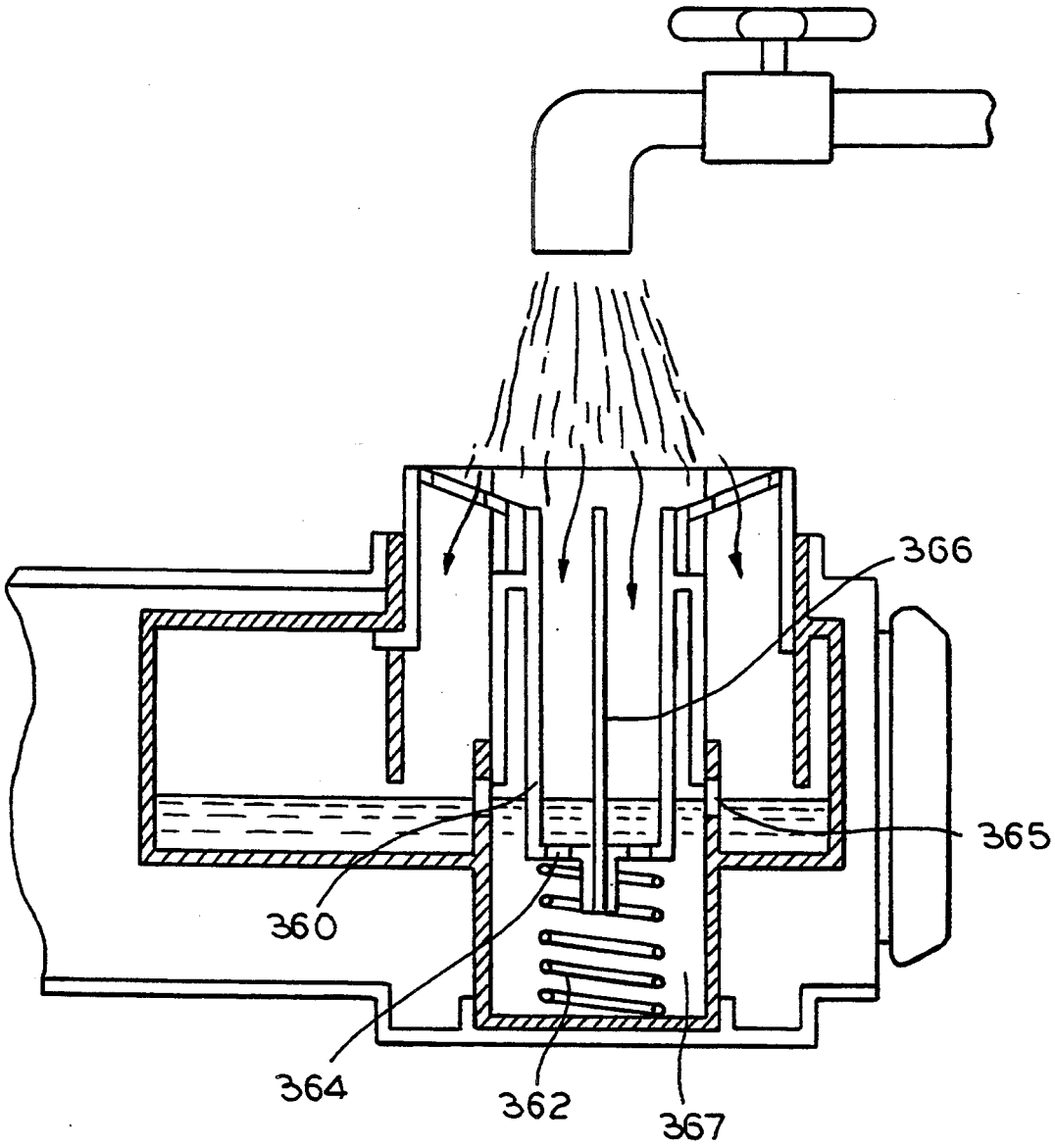
FIG. 21 is a partial, cut-away view showing the manner in which the reservoir of the toy weapon of FIG. 20 is filled.

In FIG. 20, yet another embodiment of the invention is illustrated comprising a combination water-filled bullet capsule system and a pump action squirt gun. In this embodiment, illustrated and described in greater detail below in connection with FIGS. 21–25, a control lever 302 is positioned on the side of the weapon 300 to select the choice of play, i.e. bullet action or pump action. A water reservoir 304 is located in the gun stock 306. There is a transparent slot 308 located next to water cap 310 to indicate the level of the water in the reservoir. A filling valve (FIG. 21) is also provided, covered by water cap 310, for both filling the reservoir through a water tap and for filling individual capsules from the reservoir.

This combination toy weapon is operated as follows:

A. Open water cap 310, fill reservoir 304 (FIG. 21), and close cap.

B. Move control lever 302 to bullet action position.

Figure 24:
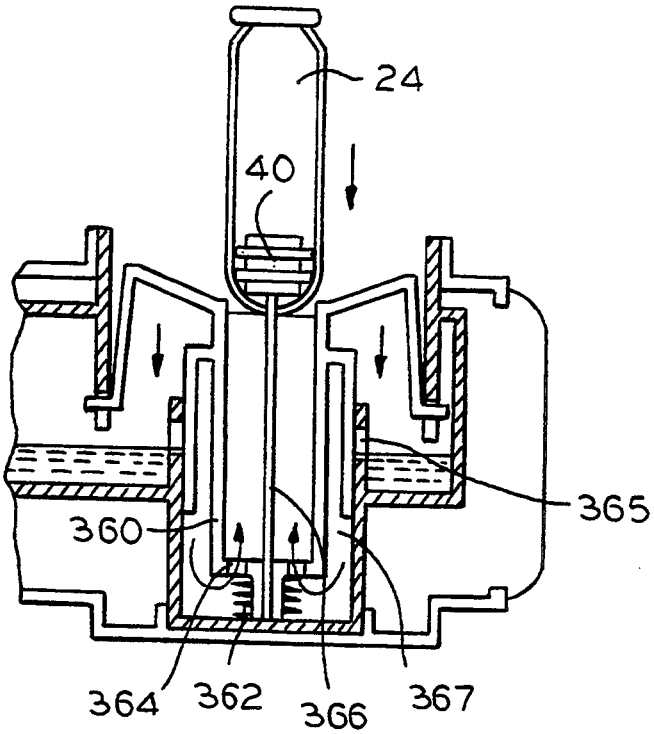
FIGS. 24, 24A and 25 are partial, cut-away elevation views of the capsule filling reservoir of the toy weapon of FIG. 20.
Figure 24A:
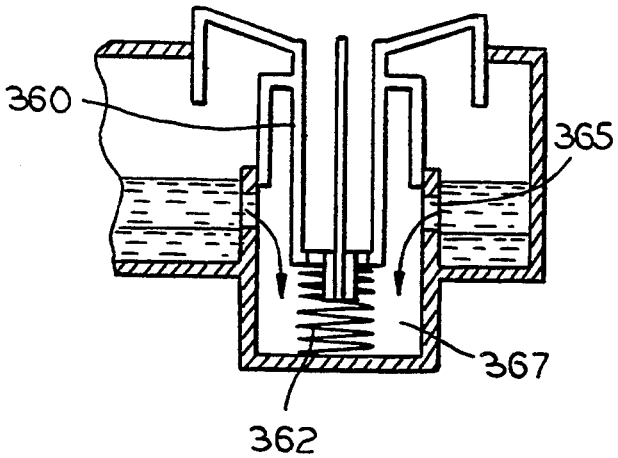

C. Open water cap 310 and push empty bullet capsules 24 one by one into the valve to fill them with water, as illustrated in FIG. 24.

Figure 22:
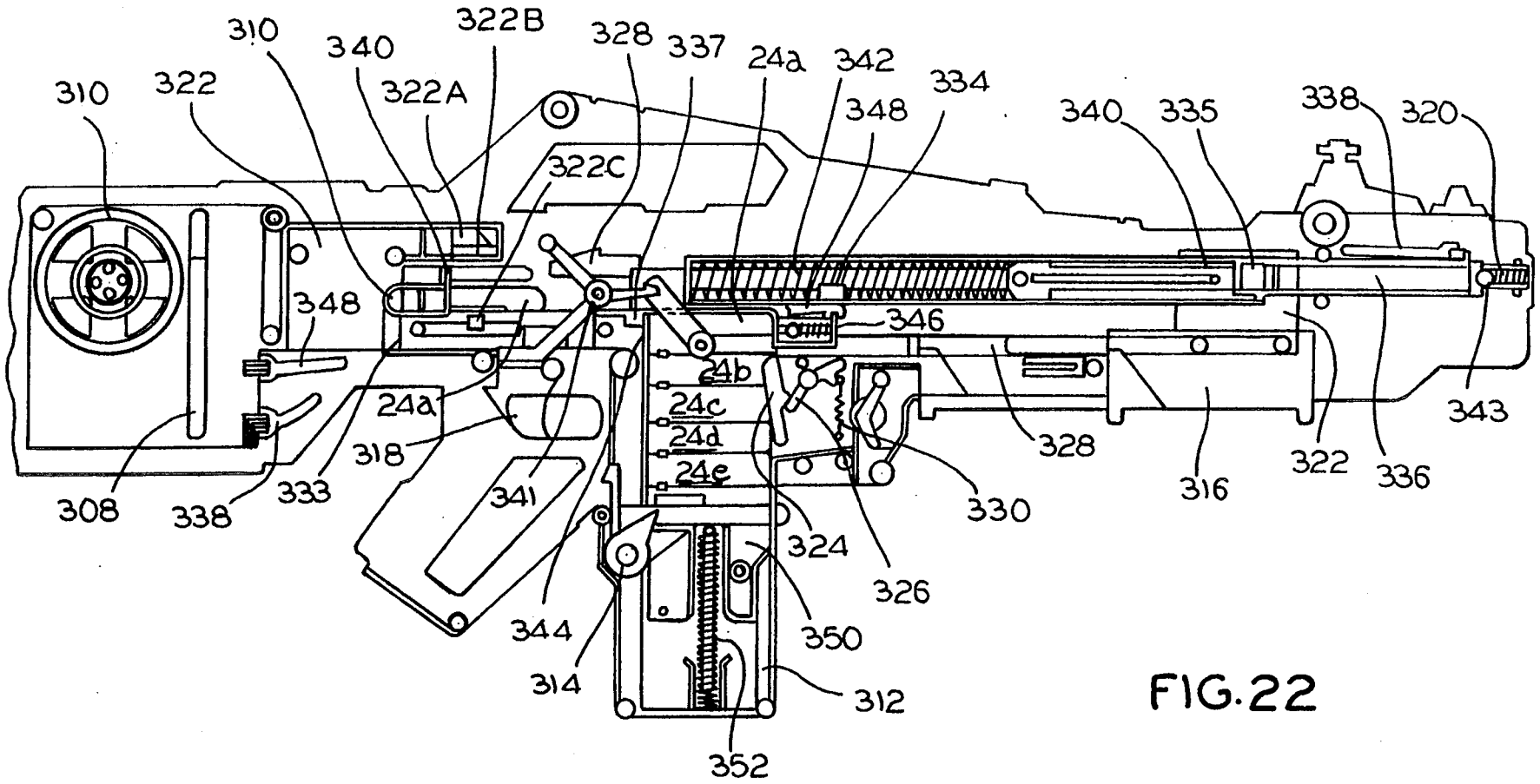
FIG. 22 is a cut-away side elevation view of the toy weapon of FIG. 20.

D. Close water cap 310 and load the water-filled capsules into magazine 312 (FIG. 22).

E. Insert magazine 312 (loaded with water-filled capsules **24*a*–24*e*) into the body of the weapon and lock in place with lock lever 314**.

F. Pull slide handle 316 to the rear (left in FIG. 22) until a click is heard and then return it to its forward position.

G. Pull trigger 318 to shoot. The water stream emerges from nozzle 320 to travel a substantial shooting distance. In one embodiment, the shooting distance is 28 feet, and the reservoir contains 580 cc of water. If all proximately 7.5 cc of water is used in each shot, this reservoir will provide 77 shots of bullet play or pump action play.

H. As slide handle 316 is again moved rearwardly, the now empty bullet capsule **24*a*** is ejected through the opening and a click sound is heard again after which the handle is returned to its forward position in preparation for the second shot. This procedure is repeated for each shot.

I. After the last bullet capsule (**24*e***) in the magazine is ejected, the slide handle automatically locks in its forward position. There is one more shot which may be triggered before the child either takes the magazine out of the weapon to reload the water-filled bullets for another round of bullet action play or the child changes over to pump action play.

J. In order to change the play mode to pump action (at any time), control lever 302 (FIG. 20) is moved to the forward pump action position, disabling trigger 318 and thereby halting all bullet action. The slide handle is then moved backwardly and released, returning automatically to its forward position as a water stream emerges from nozzle 320. The stream may be made continuous by pumping the slide handle until reservoir 304 is exhausted.

The above features are provided by a single pump mechanism which produces both the bullet action play and the pump action play. In order to obtain this dual function from a single pump mechanism, the water which appears to be ejected from the nozzle in the bullet action play mode actually has already been emptied from the capsule into the water reservoir by the operation of the slide handle to be drawn out and ejected by the pump mechanism which draws the water from the water reservoir through a connecting tube.

Figure 23:
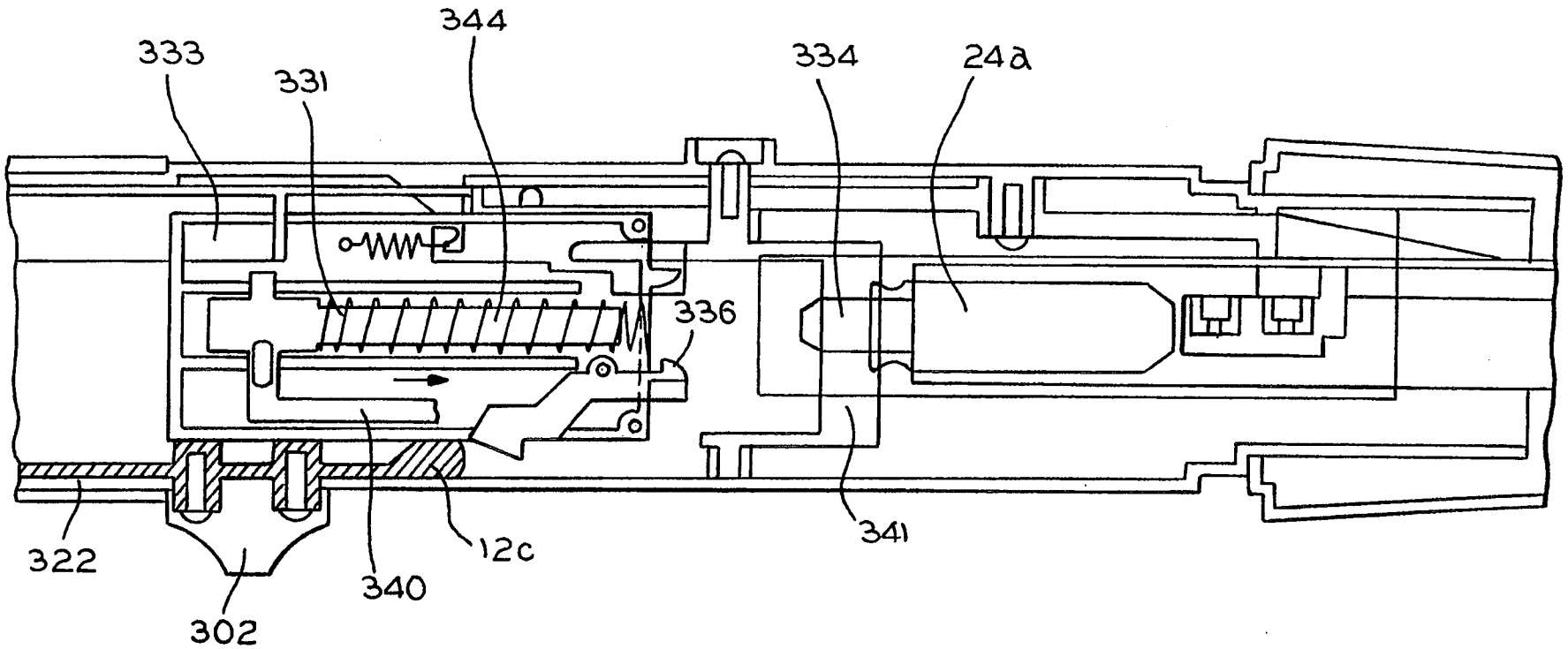
FIG. 23 is a partial, cut-away top view of the center portion of the toy weapon of FIG. 20.

The details of the mechanism of the above dual mode toy weapon are illustrated in FIGS. 22 and 23. Control lever 302 is permanently fixed to an internal trigger box 322. By pushing the control lever to bullet action position, trigger box 322 is moved out of the way to prevent contact with the levers for pump action play, as more fully described below.

When magazine 312 is inserted into the gun body, the bullet capsules in the magazine push arm 324 to the right, turning lever 326 out, to raise the right side of lock lever 328 upwardly, freeing up slide handle 316. If, however, there was no bullet capsule in the magazine, lever 326 would be pivoted downwardly by spring 330 and the right side of the slide handle would drop to the original lower position to prevent the slide handle from moving backwardly until a bullet-filled magazine is loaded into the gun or the play mode is changed to pump action play.

Now, as slide handle 316 is pulled back, connecting arm 332 pushes piston shaft 334 and its resilient piston 335 to the rear drawing water into chamber 336 from reservoir 304 through hose 338. As illustrated in FIG. 23 this pulling action moves metal shaft 340, connected to arm 332 and bullet plunger 333, forcing the bullet plunger back so that hook 336 in the front part of the bullet plunger may eject the empty capsule from the weapon and admit a fresh water-filled capsule. When end tip 337 of piston shaft 334 is hooked by trigger lever 341, spring 342 will have already been fully cocked. By returning the slide handle to the forward position, bullet capsule plunger 333 is pulled forwardly, to hold the water-filled bullet in place. The return action causes shaft 344 to drive the water inside the bullet out of the valve 346 and into the reservoir 304 through hose 348.

When trigger 318 is pulled to fire the bullet action weapon, it pushes trigger lever 341 upwardly so that its other end moves downwardly, releasing piston shaft 323. Spring 342 then pushes the piston shaft forward to drive water out through nozzle 320, which is shown with an optional, conventional one-way valve 343 to prevent water leakage. This procedure is repeated for following shots, after each of which the empty bullet capsule is ejected and the next water-filled bullet capsule is pushed up by part 350 and spring 352 to replace the spent capsule.

When the action mode is changed to pump action, trigger box 322 is moved forward to alter the following three mechanical actions:

I. Portion 322A pushes trigger lever 341 away from the hooking and triggering position, enabling piston shaft 334 to move back and forth freely.

II. Portion 322B of trigger box 322 forces front end lever 328 downwardly, while its right side is pivoted upwardly to permit the front end to move back and forth freely.

III. Portion 322C of the trigger box locks plunger hook 336, preventing bullet ejection. Slide handle 316 and piston shaft 220 are now free to move, for continuous pumping operation without touching trigger 318.

Figure 25:
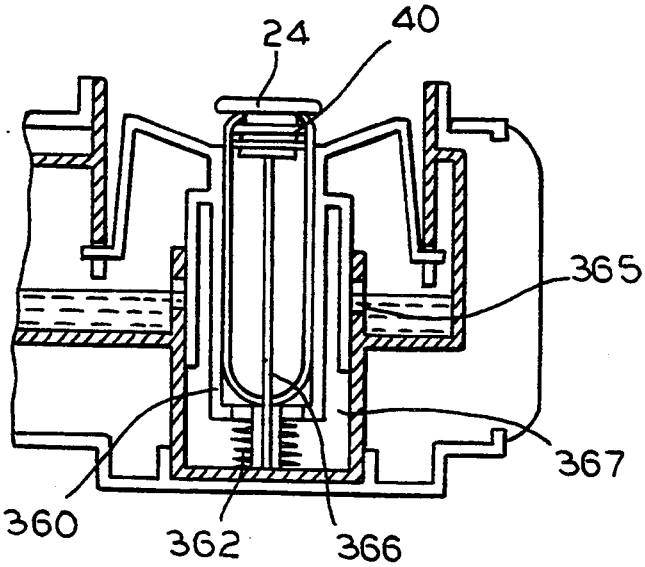

The water filling mechanism of the device combines the filling of the reservoir with the capability of filling individual capsules from that reservoir. The mechanism insures that the bullet capsules can always be filled to capacity even when the water in the reservoir becomes low. This is illustrated in FIGS. 24 and 25.

Thus, when cap 310 is opened, cylinder 360 will be pushed upwardly by spring 362. The water in the reservoir flows down through holes 365 in cylinder 367. Cylinder 360 is then pushed down as a bullet capsule is inserted into it forcing the water in cylinder 367 to flow up into cylinder 360 through holes 364 in cylinder 360 thereby causing the water level in cylinder 360 to rise to a volume equal to the volume in one bullet capsule. As the capsule is then pushed down, shaft 366 pushes the capsule stopper 40 upwardly to extract water from the reservoir. Thus, even if the water in the reservoir is low, the bullet will be filled.

Figure 26:
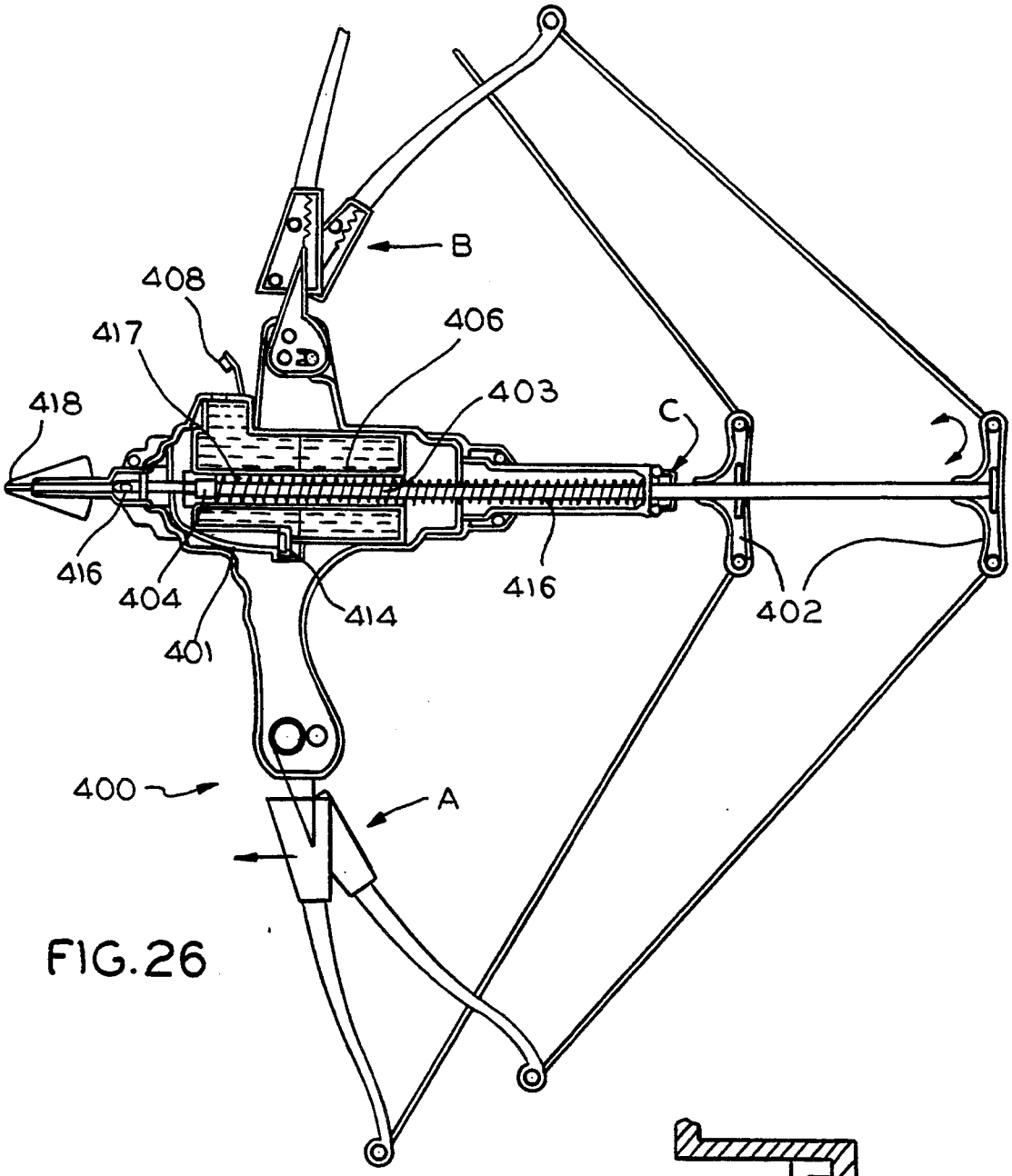
FIG. 26 is a partially cut-away elevation view of a crossbow toy in accordance with the invention and FIG. 26A is an enlarged cut-away view of the one-way valve of the crossbow toy of FIG. 26.
Figure 26A:
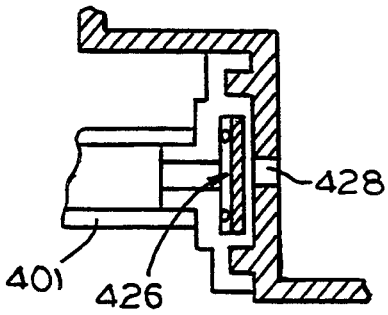

Next, a crossbow toy is illustrated in FIG. 26. In order to operate crossbow 400, arrow handle 402 is pulled back by the child against a spring force presented at points A & B. This action also moves shaft 403 and piston 404 backwardly, drawing water from reservoir 406 (closed off by cap 408) into chamber 417 through one-way valve 414 and tube 401. One-way valve 414, which is shown in enlarged form in FIG. 26A, includes a membrane 426 which opens and closes across passage 428 to permit water to be drawn from the reservoir while preventing backflow. The pulling of the arrow handle cocks spring 416, which may be immediately released to empty the reservoir in a single operation or locked in its cocked state. Locking in the cocked state may be accomplished with the structure of FIG. 27 which would be located at C in FIG. 26. In this embodiment handle 402 is adapted to be twisted to the right or to the left, to rotate shaft 403 45° in either direction so that rib 420 in the shaft engages one of stoppers 422 and 424 thereby locking the entire mechanism. Thus, when the child is ready to fire the locked, cocked crossbow, handle 402 is returned to the middle position and released. Thus, when the handle is released, whether from a locked, cocked position or not, spring 4 16 will push shaft 403 and piston 404 forward to force the water out of the bow through valve 416 and nozzle 418. Valve 426 serves as a one-way valve to prevent water leakage from the nozzle. Finally, the bow arms may be folded for easy storage and packaging.

In an alternative embodiment of the present invention which may be employed with any of the above-described action toys, a double feature nozzle is employed to produce a water stream or to propel an object. This alternative embodiment is illustrated in FIGS. 28 and 29, in the form of an elongated nozzle 418A which replaces nozzle 418 in FIG. 26.

Figure 28:
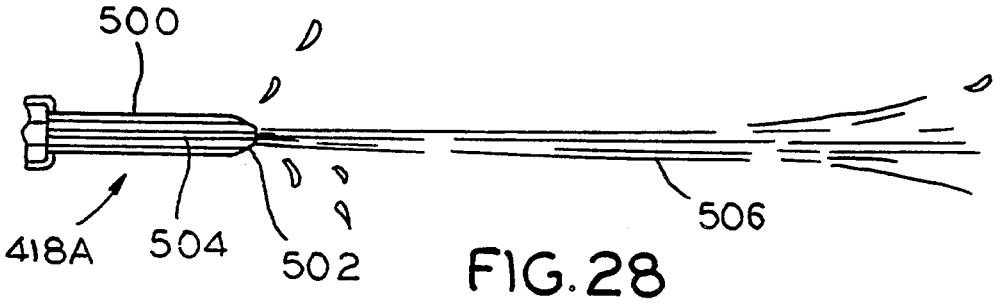
FIGS. 28 and 29 are partial, cut-away views of an alternative double feature nozzle design intended to replace the nozzle in the crossbow toy of FIG. 26.

As illustrated in FIG. 28, double feature nozzle 418A has a tubular outer surface 500 and a rounded tip 502 with a longitudinal passage 504 in communication with chamber 417 (FIG. 26). A water stream 506 is shown emerging from the tip.

Figure 29:
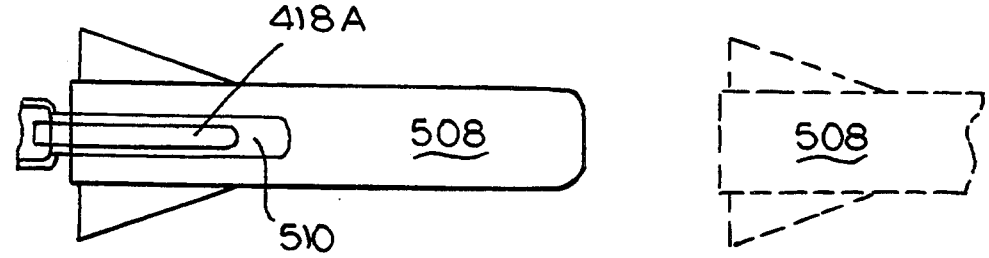

Turning now to FIG. 29, a lightweight resilient arrow-shaped object 508 having an internal tubular internal cavity 510 is shown mounted to the double feature nozzle. The object may, of course, be made in any shape, although a generally aerodynamic shape is preferred. The object may be made of any lightweight material such as, for example, foamed polyethylene. Also, the internal tubular cavity 510 should have resilient walls and a diameter less than that of the nozzle so that the walls seal against the outer surface of the nozzle. Thus, in one design, a 2.5 inch long nozzle with an external diameter of 0.280 inches was found to work well with an extruded, foamed polyethylene arrow having a 2.6 inch long internal tubular cavity with a diameter of 0.274 inches. Object 508 may be mounted to nozzle 418A whether or not reservoir 406 and chamber 417 contain water, although it is preferred that the reservoir and chamber be empty. When the object is mounted to the nozzle and the crossbow is cocked and released as described above, the air or water pressure produced at the nozzle will propel the object forward as shown in outline form in FIG. 29.

Figure 27:
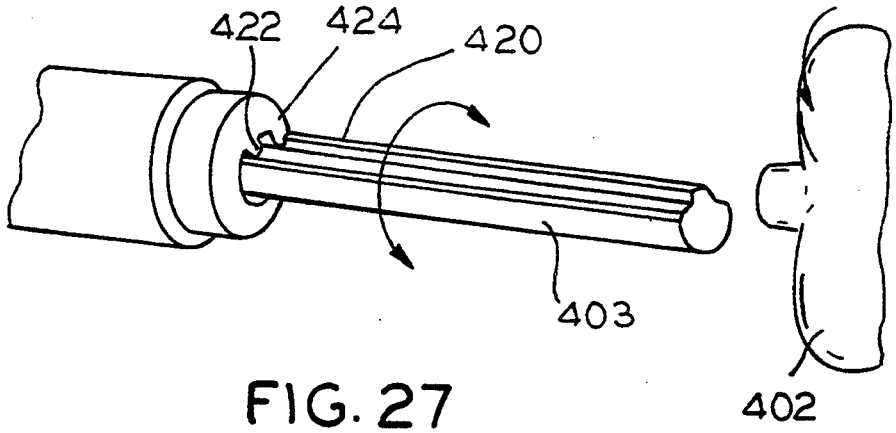
FIG. 27 is a partial, enlarged cut-away view of the shaft locking mechanism of the toy of FIG. 26.
Figure 30:
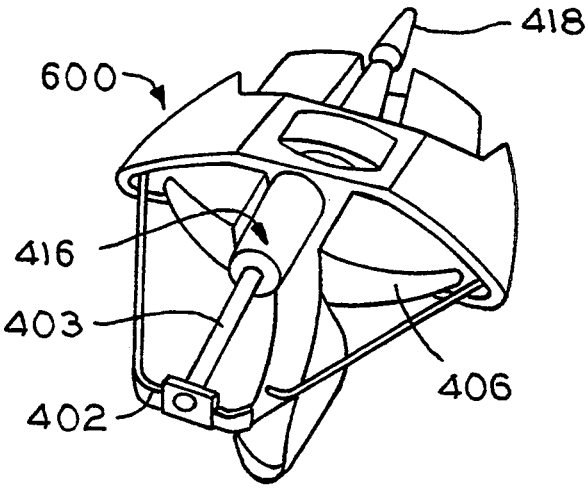
FIG. 30 is an alternative, futuristic crossbow toy in accordance with the present invention.

Finally, a futuristic crossbow 600 is illustrated in FIG. 30. This crossbow operates in the same fashion as that illustrated in FIG. 26 and therefore its features have been labelled with identifying numbers:used in FIG. 26. Futuristic crossbow 600 does not include a mechanism for locking spring 416 (FIG. 27). Accordingly, this embodiment will empty upon release of the handle.

While the present invention is described above in connection with preferred or illustrative embodiments, these embodiments are not intended to be exhaustive or limiting of the invention. Rather, the invention is intended to cover any alternatives, modifications, or equivalents, which may be included within its spirit and scope, as defined by the appended claims.

The invention claimed is:

1. An action toy comprising:

a plurality of capsules for containing a liquid, each of said capsules having an orifice;

means for driving liquid from each of said capsules through said orifice;

means in said toy for ejecting successive capsules after said liquid is driven therefrom;

a housing for supporting each of said capsules for successively driving liquid therefrom;

spring means for storing energy;

means for successively subjecting each of said capsules to the stored energy of said spring means; and trigger means for releasing the stored energy of said spring means to said driving means.

2. The action toy of claim 1 wherein said spring means is a compression spring.

3. The action toy of claim 1 wherein said driving means includes a plunger mounted for sliding movement within said capsule.

4. The action toy of claim 3 wherein said plunger includes at least one "O" ring.

5. The action toy of claim 1 wherein said housing includes an elongated passage in communication with said orifice for directing liquid ejected from said capsule.

6. The action toy of claim 5 including an intermediate chamber for receiving water driven through said orifice before it enters said elongated passage.

7. The action toy of claim 6 including a one-way valve at the point at which said intermediate chamber receives water driven through said orifice.

8. The action toy of claim 1 wherein said liquid is water and said capsule is substantially filled with water.

9. The action toy of claim 1 which said capsule has an orifice with a diameter of less than about 2.5 mm.

10. The action toy of claim 1 including a longitudinally sliding handle for cocking said spring means.

11. The action toy of claim 1 including means for replacing said spent capsules with substantially filled capsules.

12. The action toy of claim 1 wherein said capsules are contained within said housing.

13. The action toy of claim 12 in which said housing is in the shape of a shotgun.

14. The action toy of claim 1 wherein said capsules are mounted to the end of said housing.

15. The action toy of claim 14 in which said housing is in the shape of a missile launcher.

16. The action toy of claim 1 in which said trigger means is in the form of a conventional weapon trigger.

17. The action toy of claim 1 in which said capsule includes a bellows portion.

18. An action toy comprising:

a housing in the shape of a weapon;

a capsule for containing a liquid, said capsule having an orifice;

a chamber, associated with said housing, for receiving said capsule;

means, associated with said housing, for driving liquid out of said capsule through said orifice;

spring means for storing energy;

first trigger means, for releasing the stored energy of said spring means to said driving means;

a liquid reservoir in communication with said housing;

means for pumping the liquid from said reservoir for ejection from said housing; and second trigger means for operating said pumping means, 19. The action toy of claim 18 including a plurality of capsules adapted to the successively subjected to the stored energy of said spring means thereby successively driving the liquid from each of said capsules through their respective orifices.

20. The action toy of claim 18 wherein said spring means is a compression spring.

21. The action toy of claim 18 wherein said driving means includes a plunger mounted for sliding movement within said capsule.

22. The action toy of claim 18 including an elongated passage in communication with said orifice for directing liquid ejected from said capsule.

23. The action toy of claim 18 wherein said reservoir is detachable from said housing.

24. The action toy of claim 18 wherein said pump means is driven by an electric motor.

25. A dual mode action toy comprising:

a housing in the shape of a weapon;

a capsule for containing a liquid;

a chamber, associated with said housing, for receiving said capsule;

a liquid reservoir, in communication with said housing;

means, associated with said housing, for driving liquid out of said capsule and into said reservoir;

means for pumping the liquid from said reservoir for ejection from said homing, said pumping means being operable in a first mode in which liquid is driven from said capsule into said reservoir and pumped from said reservoir for ejection from said housing, and a second mode in which no liquid is driven from said capsule but liquid is nevertheless pumped from said reservoir for ejection from said housing.

26. The dual mode action toy of claim 25 including means for switching between modes.

27. The dual mode action toy of claim 25 wherein said reservoir includes means for loading the liquid into said capsules.

* * * * *